United States Patent [19]

Williams

[11] Patent Number: 4,860,387

[45] Date of Patent: Aug. 29, 1989

[54] DOLL DECORATED GARMENT WITH DETACHABLE DOLL CLOTHING

[76] Inventor: Lesia M. Williams, 5554 Kingsport Dr., Atlanta, Ga. 30342

[21] Appl. No.: 261,601

[22] Filed: Oct. 24, 1988

[51] Int. Cl.[4] ..... A41D 27/08; A41B 1/00

[52] U.S. Cl. ..... 2/244; 2/49 R; 446/28

[58] Field of Search ..... 2/49 R, 49 A, 74, 75, 2/80, 105, 106, 113, 114, 244; 446/26, 28

[56] References Cited

U.S. PATENT DOCUMENTS 3,484,974 12/1969 Colmone ..... 2/244 X
3,724,101 4/1973 Slezak ..... 2/74 X
4,710,979 12/1987 Bull et al. ..... 2/49 R X
4,723,323 2/1988 Wright, Jr. ..... 2/49 R
4,776,043 10/1988 Coleman ..... 2/244 X

FOREIGN PATENT DOCUMENTS 0142257 5/1985 European Pat. Off. ..... 2/113

*Primary Examiner*—Werner H. Schroeder
*Assistant Examiner*—Jeanette E. Chapman
*Attorney, Agent, or Firm*—Thomas & Kennedy

[57] ABSTRACT

A decorated garment (11) has a plurality of doll figures (12, 13, 14) mounted on its front surface. Articles of clothing (26) for each of the doll figures are adapted to be attached to the doll figures to provide decorative wardrobes for the doll figures.

11 Claims, 2 Drawing Sheets

DOLL DECORATED GARMENT WITH DETACHABLE DOLL CLOTHING

BACKGROUND OF THE INVENTION

This invention relates to garments with decorative figures thereon, and, more particularly, to children's garments having doll figures thereon and detachable clothing for the doll figures.

Some children's garments have decorations such as doll figures or the like sewn thereon which afford pleasure and amusement to the children. However, because these figures are permanently affixed to the garment, the novelty soon wears off and the figures are ignored by the child.

Accordingly, it is an object of the invention to provide a child's garment decorated with figures and to provide clothing items for the figures with the clothing items being releasably attached to the figures and readily interchangeable with other clothing items.

It is another object of the invention to provide a child's garment with doll, animal or other figures and interchangeable clothing for the figures that when in place the figures are firmly attached to the clothing, and yet which can be removed quickly and easily.

It is still another object of the invention to provide a child's garment as described above and which has interchangeable clothing for the figures, with the interchangeable clothing being sufficiently stiff to retain its shape and lie firmly in place.

SUMMARY OF THE INVENTION

Briefly described, the invention comprises a garment having one or more doll-like, animal-like or other figures sewn or otherwise attached thereto, each of which has an attachment structure such as a layer of soft fastening material like the loop portion of Velcro® attached in place on the figure and conforming in outline to the outline of the figure. The clothing for the figures, which may encompass a broad range of styles such as dresses, jeans and blouses, coveralls, sports uniforms, military uniforms and the like, is of sufficient stiffness to give "body" to the clothing and to lessen the tendency of the clothing to curl or flop. Mounted on the clothing material are one or more patches of the mating or hook portion of the Velcro® or other attachment structures. The clothing is pressed into place on the figure, and the Velcro® patches mate with the loop Velcro® on the figure to hold the clothing firmly in place.

Even though the clothing is held firmly in place, it can readily be removed when desired and new, different clothing may be attached. Thus, each figure on its garment may be supplied with a complete wardrobe if desired, affording the child considerable amusement in selecting clothing for the doll figures.

It has been found that, during manufacture of the garment, a layer of stabilizing material applied to the inside of the surface upon which the dolls are to be sewn or mounted facilitates the mounting process. In those cases where the stabilizing material is used, after the stitching has been done, the fringe of stabilizing material protruding from behind the figure can be removed by simply tearing it away, the stitching having created a perforated line in the stabilizing material along which the tear occurs.

DESCRIPTION OF THE DRAWINGS

The present invention will be more readily understood from the following detailed description, read in conjunction with the accompanying drawings, in which.

DETAILED DESCRIPTION

Figure 1:
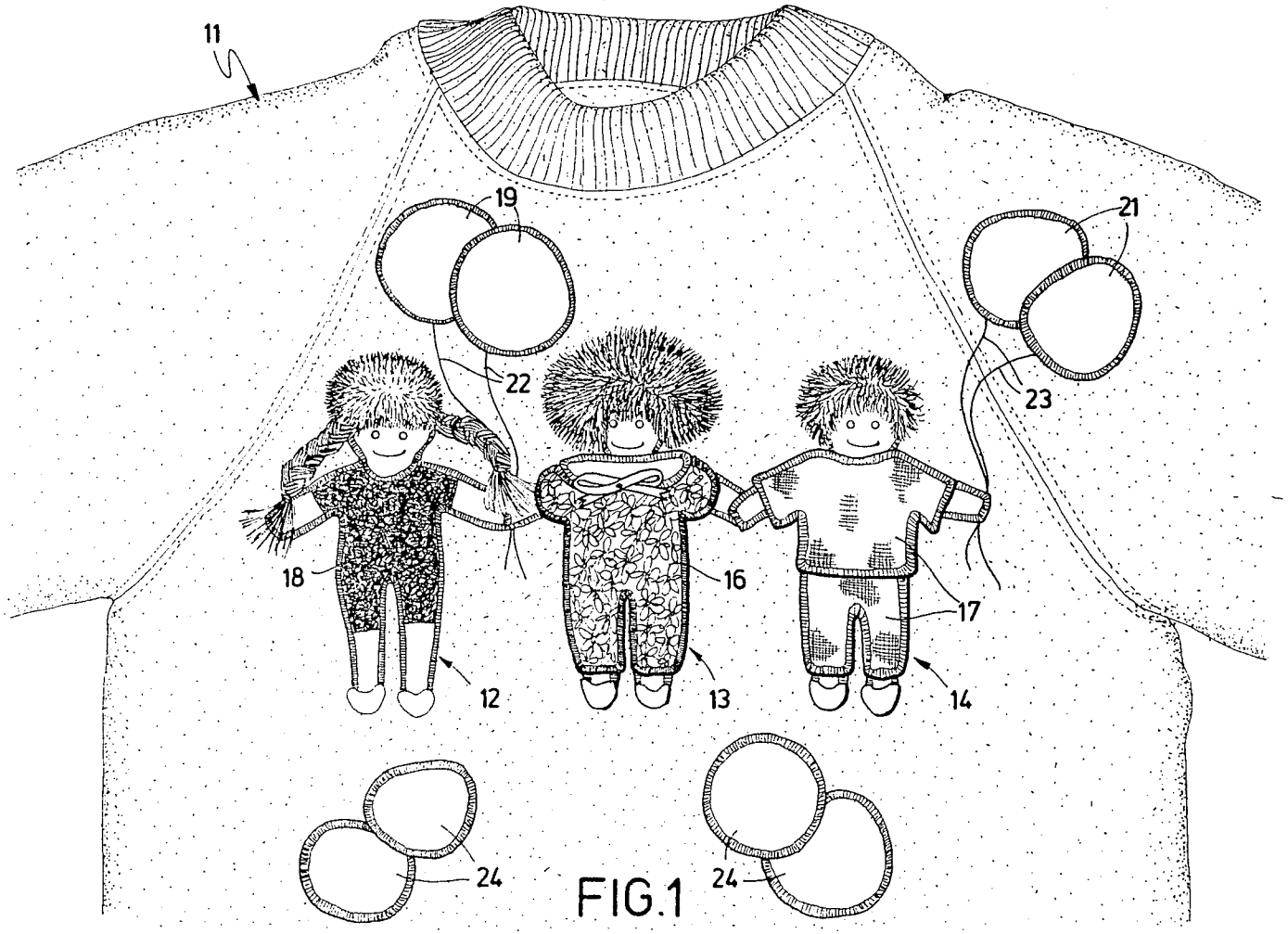
FIG. 1 is a front view of a garment embodying the features of the present invention.

Referring now in more detail to the drawings in which like numerals indicate like parts in all views, FIG. 1 shows a garment 11 which, for illustrative purposes only, can be considered a child's sweat shirt. It is to be understood that any number of different children's garments may embody the principles of the invention, that shown in FIG. 1 simply being one example. Mounted on the outer surface or face of the garment 11 are first, second, and third doll figures or human shapes 12, 13 and 14, which are preferably sewn in place. A layer of material is cut to the proper shape and sewn about its edges to the garment to form the human shapes 12, 13 and 14. As was pointed out in the foregoing, a backing of stabilizing material on the outer surface of the front of the garment 11 may be used to impart a degree of stiffness to the FIGS. 12, 13 and 14.

While the FIGS. 13 and 14 are shown with clothing 16 and 17 respectively in place, the figure 12 is shown without clothing. Mounted on the garment 11 within the boundaries of the FIG. 12 and covering a large portion thereof, is a soft Velcro® layer 18 which conforms to the outlines of the figure. The loop portion of Velcro® material is generally considered the soft portion, and it is preferable that this portion comprise layer 18, mounted by sewing about its edges to the FIG. 12 and hence to garment 11. FIGS. 13 and 14 have similar layers of fastening material, not shown, to which clothing items 16 and 17 are affixed.

The clothing items 16 and 17 of FIG. 1 must be relatively stiff and stable so as to retain their shapes during use. Typically, the decorative material used for clothing items will be reinforced with additional layers of material. For example, a large sheet of decorative material is fastened to a fusible nylon sheet, by overlying the nylon sheet on the back of the decorative material and pressing with a hot iron. The material is turned over so that its non-decorative, nylon backing sheet faces upwardly and the shapes of the clothing items are sketched or otherwise applied to the nylon material. The figures are then cut from the two plies of material.

A heat fusible nylon material suitable for this purpose is known by the brand name Easy Knit which is available from Stacey Fabric Corporation, 30 Passaic Street, Woodridge, N.J. 07075.

Figure 2:
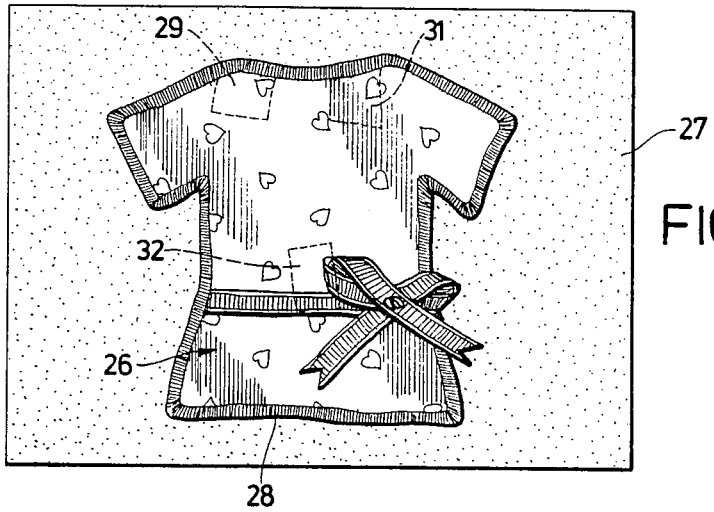
FIG. 2 is a front view of one step in the manufacture of the clothing for a doll figure.
Figure 3:
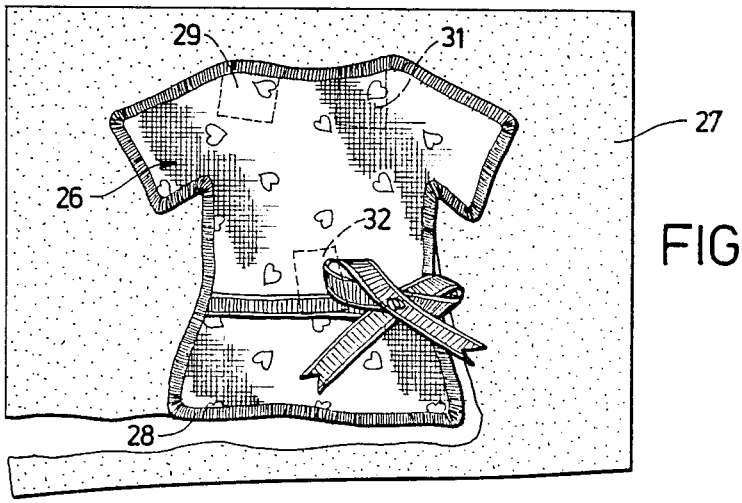
FIG. 3 is a front view of the clothing of FIG. 2, showing a subsequent step in the manufacturing process.

As shown in FIG. 2, the dress pattern 26 which has been cut from the layers of decorative material and heat fusible material is placed on one or more layers of a backing sheet 27 of nonwoven tear away material such as, for example, Tearaway, which is available from Staple Sewing Aid Corp., 141 Lanza Avenue, Garfield, N.J., 07026. The edges of the pattern are then stitched with edge stitching 28, thereby creating a perforated outline of pattern 26 in layer 27. The excess portion of layer 27 is then removed by simply tearing it away along the perforated line, as shown in FIG. 3. The back surface of layer 27 within the pattern outline has mounted thereto, as by stitching, a plurality of tabs or patches 29, 31 and 32, of fastening material such as the hook portion of Velcro® material. These tabs can be sewn into the edge stitching 28 during the step of sewing the nonwoven material 27 to the clothing item.

Figure 4:
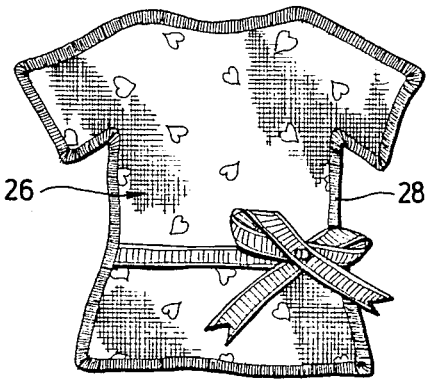
FIG. 4 is a front view of a dress for mounting on one of the figures shown in FIG. 1.
Figure 5:
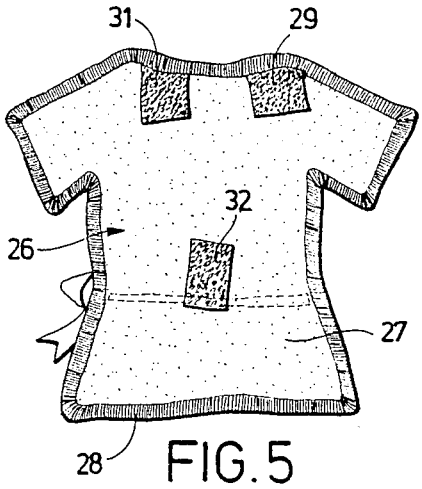
FIG. 5 is a rear view of the dress of FIG. 4.

The finished clothing item, dress 26 as shown in FIGS. 4 and 5, can be adorned with additional accessories such as belts and bows, if desired. In mounting the dress 26 to FIG. 12, patches 29, 31 and 32 of the dress mesh with layer 18 of the FIG. 12 and, upon application of pressure, dress 26 becomes firmly affixed to FIG. 12. On the other hand, it is a simple matter to pull dress 26 off of FIG. 12 and to attach a different clothing item when desired, as can be done with FIGS. 13 and 14.

For added interest, the garment of FIG. 1 has mounted thereon patches 19 and 21 representing balloons, attached to FIGS. 12 and 13, and 14 by strings 22 and 23 respectively. Other bright color patches 24 may also be used to enliven the garment scene.

Each of the FIGS. 12, 13 and 14 may be supplied with hair made from yarn using a single, double or triple straight stitch for strength and the "hair" is then styled and cut. Various bows and trims may also be added. The eyes and mouth of each of the FIGS. 12, 13 and 14 are preferably stitched, for permanency and appearance, although they may be painted on using suitable paint material. The shoes of the figures are preferably, although not necessarily, made of suede which is glued in place with suitable craft cement. The balloons and other decorations are then stitched on. As a last step, the clothes for the FIGS. 12, 13 and 14 are sprayed with water and suitable stain resistant material, such as, for example, Scotchguard®.

From the foregoing it can be seen that the principles of the present invention are embodied in a child's garment in which the appearance of decorative figures may be readily changed at the whim of the child, affording the child amusement and pleasure. These same principles may be used in decorating other than children's clothing such as doll clothing, pillow decoration, adult clothing and the like, without departure from the spirit and scope of the invention. Also while the garment has been illustrated with human shapes and articles of clothing for human shapes, other type shapes and clothing can be used, such as animal shapes and clothing.

While this invention has been described in detail with particular reference to a preferred embodiment thereof, it will be understood that variations and modifications thereof might be evolved which are within the spirit and scope of the invention as described in the following claims.

I claim:

1. A garment having a garment face, at least one doll figure or the like having front and rear surfaces, said figure being mounted on said garment face with its rear surface contacting said garment face, the said front surface of said figure having attached thereto a layer of fastening material, an article of clothing or the like for said figure, said article of clothing having a layer of stabilizing material and a front surface and a rear surface, and at least one member of fastening material mounted to the rear surface of said article of clothing.

2. A garment as claimed in claim 1 wherein said stabilizing material is heat fusible material.

3. A garment as claimed in claim 2 wherein said stabilizing material is heat fusible woven nylon.

4. The garment as claimed in claim 1 wherein said stabilizing material is nonwoven material.

5. A garment as claimed in claim 1 wherein said layer of fastening material and said member of fastening material are mating members of a resilient fastener.

6. A garment as claimed in claim 5 wherein said fastening materials are of Velcro®.

7. A decorated garment having a garment surface and including at least one removable shape releasably mounted thereon, at least one doll figure or the like mounted to said garment surface, said doll figure having a front visible surface, fastening material stitched to the front visible surface of said doll figure and conforming to the outline of said doll figure over at least a portion thereof, said removable shape comprising an article of clothing for said doll figure having a front surface and a rear surface, said rear surface comprising a layer of fusible stabilizing material heat sealed to said article, and at least one member of fastening material stitched to said layer of stabilizing material, said member of fastening material being adapted to mate with the fastening material on the front visible surface of said doll figure to attached said article of clothing to said doll figure.

8. A decorated garment as claimed in claim 7 wherein said fusible material is fusible woven nylon.

9. A decorated garment as claimed in claim 7 wherein the fastening material is Velcro®.

10. A garment having an outer surface, a human shape or the like mounted on the outer surface of the garment, first fastener means attached to the garment at a position within the boundaries of the human shape of the garment, an article of clothing or the like sized and shaped to approximately conform to the size and shape of the human shape, second fastener means cooperative with said first fastener means carried by said article of clothing for attaching the article of clothing to the human shape.

11. An article of clothing or the like formed by the process of:

attaching doll figures to a face of the article of clothing, attaching first fastener means to the face of the article of clothing at said doll figures, heat fusing a layer of decorative material to a layer of fusible material, cutting garment shapes in sizes and shapes that conform to the doll figures from the fused layers of material, attaching nonwoven material and second fastener means to the garment shapes, removing the nonwoven material extending from the edges of the garment shapes away from the garment shapes, and applying the garment shapes to the doll figures of the article of clothing by connecting the second fastener means of the garment shapes to the first fastener means of the doll figures.

* * * * *